US006746348B2

(12) United States Patent
Barnes et al.

(10) Patent No.: US 6,746,348 B2
(45) Date of Patent: Jun. 8, 2004

(54) BASKETBALL BACKSTOP NET ASSEMBLY AND KIT THEREFOR

(76) Inventors: Richard J. Barnes, 19 E. Washington St., Round Lake Park, IL (US) 60073-3035; James P. Fieberg, 602 Ivy Ct., Round Lake Beach, IL (US) 60073-2223

( * ) Notice: Subject to any disclaimer, the term of this patent is extended or adjusted under 35 U.S.C. 154(b) by 0 days.

(21) Appl. No.: 10/268,821

(22) Filed: Oct. 10, 2002

(65) Prior Publication Data

US 2004/0072636 A1 Apr. 15, 2004

(51) Int. Cl.[7] ..... A63B 69/00
(52) U.S. Cl. ..... 473/433; 473/431; 473/447
(58) Field of Search ..... 473/485, 479, 473/477, 472, 473, 466, 459, 446, 447, 433, 451; D21/702, 703

(56) References Cited

U.S. PATENT DOCUMENTS

| | | | | | |
|---|---|---|---|---|---|
| 4,072,295 | A | | 2/1978 | Roberts | |
| 4,667,957 | A | | 5/1987 | Joseph | |
| 4,762,319 | A | | 8/1988 | Krumholz | |
| 4,838,549 | A | | 6/1989 | Woodall | |
| 5,016,875 | A | | 5/1991 | Joseph | |
| 5,129,648 | A | | 7/1992 | Sweeney et al. | |
| 5,165,680 | A | | 11/1992 | Cass | |
| 5,171,009 | A | | 12/1992 | Filewich et al. | |
| 5,402,999 | A | * | 4/1995 | Keehn, Sr. | 473/472 |
| 5,540,428 | A | | 7/1996 | Joseph | |
| 5,730,666 | A | | 3/1998 | Hudson | |
| 5,785,616 | A | * | 7/1998 | Dodge | 473/479 |
| 6,056,652 | A | | 5/2000 | Lees et al. | |
| 6,074,313 | A | | 6/2000 | Pearson | |
| 6,224,503 | B1 | * | 5/2001 | Joseph | 473/422 |
| 6,267,696 | B1 | | 7/2001 | Mabe et al. | |
| 6,416,431 | B1 | * | 7/2002 | Keehn et al. | 473/472 |
| 6,595,877 | B2 | * | 7/2003 | Pearson | 473/433 |
| 2001/0055999 | A1 | | 12/2001 | Bush | |
| 2002/0025865 | A1 | | 2/2002 | Pearson | |

* cited by examiner

*Primary Examiner*—Gregory Vidovich
*Assistant Examiner*—M. Chambers
(74) *Attorney, Agent, or Firm*—Christopher J. Scott; Charles F. Meroni, Jr.; Meroni & Meroni, P.C.

(57) ABSTRACT

The present invention provides a backstop net assembly and kit for use in combination with a basketball hoop assembly, which comprises a multi-socketed mounting block, a plurality of net extension rods, and a ball-gathering net assembly. In a basketball playground, one can find an upright support post, a backboard mounted on the post, and a basketball rim and net structure mounted on the backboard. The present invention provides a basketball backstop net assembly to gather errant basketball shots launched by a basketball shooter to minimize basketball retrieval time and possible damage to surrounding valuables. The ball-gathering net is a reticulated having a size and width, which extends vertically and laterally via the net extension rods a sufficient distance to capture errant shots and to assist in keeping the basketball in play. Additionally, a perimeter cord bounds the reticulated portion of the net to provide added strength to the ball-gathering net.

43 Claims, 8 Drawing Sheets

BASKETBALL BACKSTOP NET ASSEMBLY AND KIT THEREFOR

BACKGROUND OF THE INVENTION

1. Field of the Invention

The present invention generally relates to a backstop net assembly for use in combination with a basketball hoop assembly. More particularly, the present invention relates to a backstop net assembly for collecting and gathering errant basketball shots entering spatial regions adjacent to a backboard of a basketball hoop assembly for easy retrieval purposes.

2. Description of the Prior Art

A player engaging in the sport of basketball typically shoots, throws or propels a basketball with general projectile motion toward a basketball hoop assembly from an infinite number of possible locations around a basketball hoop assembly. Each shot, having general projectile motion, has a certain vertical component of motion, a certain horizontal component of motion, and often a certain lateral component of motion, and is typically aimed at either a horizontally-oriented, targeted rim of the basketball hoop assembly or a vertically-oriented backboard of a basketball hoop assembly, which backboard is adjacent or behind the rim for banking shots into the rim. A skilled player often can often shoot the basketball in such a manner so as to consistently hit the target, or propel the basketball so that it enters the targeted rim at some point along its trajectory. Should the shot basketball hit its target or enter the targeted rim, the player has achieved a basket and the basketball is typically directed via a basketball net of the basketball hoop assembly in a general downward motion for retrieval either by the player who shot the basketball or by other basketball players for re-executing the described procedure.

It is noted that basketball players often shoot, propel or throw basketball shots in a general projectile motion toward basketball hoop assemblies from an extreme anterior viewpoint thus visualizing a typical vertically-oriented backboard having either an arcuate or straight superior backboard border and straight lateral backboard borders are readily viewable. Further, it is noted that during play, a basketball player will frequently shoot a basketball in such a manner that the basketball will miss its targeted rim or targeted backboard and enter the open regions adjacent to the backboard borders. Such errant basketball shots thus often become cumbersome and time-consuming to retrieve. Further, it is noted that basketball hoop assemblies are often set up on playgrounds or in areas where errant shots can cause damage to various valuables located in or around the open regions surrounding a basketball hoop assembly. In light of the deleterious or burdensome effects of frequently experienced errant basketball shots, a number of apparatuses and devices have been developed in an effort to help collect, catch, and often return basketball shots, errant or otherwise, to the basketball player. In this regard, the prior art teaches a variety of basketball collection and/or retrieval apparatuses and devices, some of which are described hereinafter.

U.S. Pat. No. 4,762,319 ('319 Patent), which issued to Krumholz, discloses a Convertible Sports Stand Construction. The Convertible Sports Stand Construction comprises a frame which has spaced-apart support members adapted to reset upon a supporting surface, a net extending between the support members, and a backboard carrying a basketball goal hoop supported between the support members above the net. The backboard may be adjustably rotated horizontally between a vertical position and a horizontal position, whereby the basketball goal hoop can be positioned to extend horizontally or vertically.

It will thus be seen that the '319 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '319 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '319 Patent does not teach a backstop net assembly, which is sized and shaped to be concentrical with the superior border and lateral borders of a typical vertically-oriented backboard.

U.S. Pat. No. 5,016,875 ('875 Patent), which issued to Joseph, discloses a Portable Basketball Retrieval Apparatus. The Portable Basketball Retrieval Apparatus comprises a vertically-extensible and collapsible support frame, support arms pivotally connected to the support frame, and netting material attached to the support arms for retrieving and collecting shot basketballs and a chute permanently secured to the netting material for directing retrieved basketballs therethrough to a guideway. The apparatus is adapted for use with a post-mounted or wall-mounted backboard or alternatively, with a backboard member, which is removably secured to the top of the support frame in a position substantially the same vertical plane as the support frame.

It will thus be seen that the '875 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '875 Patent does not teach a backstop net assembly kit for outfitting existent basketball hoop assemblies so that basketball players may selectively outfit basketball hoop assemblies for catching, collecting and/or gathering errant basketball shots for easier basketball retrieval.

Further, it is noted that the '875 Patent does not teach a backstop net assembly, which is sized and shaped to be concentrical with the superior border and lateral borders of a typical vertically-oriented backboard.

U.S. Pat. No. 5,129,648 ('648 Patent), which issued to Sweeney et al., discloses a Basketball Throw Shot Practice Arrangement and Method. The Basketball Throw Shot Practice Arrangement and Method comprises a net supported by a longitudinally extending main support with lateral support arms engaging an upper edge of the net to position the net adjacent a basketball hoop on a backboard. The main support abuts the playing surface at its lower end and the hoop and backboard adjacent its upper end. Support members of substantially less longitudinal extent than the main support engage the lower edge of the net and rest on the playing surface to position the net to form a trough that is inclined downwardly and forwardly from the upper net edge to the lower net edge to guide a basketball from the hoop or backboard toward the lower edge of the net for retrieval.

It will thus be seen that the '648 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '648 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '648 Patent does not teach a backstop net assembly, which is sized and shaped to be concentrical with the superior border and lateral borders of a typical vertically-oriented backboard.

U.S. Pat. No. 5,171,009 ('009 Patent), which issued to Filewich et al., discloses a Basketball Apparatus. The Basketball Apparatus generally comprises a support member, a backboard mounted on the support member, and a hoop mounted on the backboard. The backboard is mounted on the support member for rotation with respect thereto, wherein the backboard is locatable in selected angular positions with respect to a predetermined location that is disposed remote from the support member and the backboard mounted thereon. The Basketball Apparatus further comprises tubular sockets. Mounted on the tubular sockets and extending in a vertical direction is a plurality of shortened holder sockets. The holder sockets receive bent lowermost ends of spaced inclined support elements that support a chute that is defined by two dish-like complimentary chute members that are disposed beneath the backboard and the hoop.

It will thus be seen that the '009 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '009 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '009 Patent does not teach a backstop net assembly, which is sized and shaped to be concentrical with the superior border and lateral borders of a typical vertically-oriented backboard.

U.S. Pat. No. 5,540,428 ('428 Patent), which issued to Joseph, discloses a Basketball Retrieval and Return Apparatus. The Basketball Retrieval and Return Apparatus comprises a bracket removably mountable to the lowest portion of a backboard of a basketball hoop assembly, an elongated support bar pivotally mounted to the bracket, and a U-shaped ring bar attached to the support bar and which extends outwardly from and perpendicular to the backboard when the ring bar is pivoted from a non-use to a use position. The Basketball Retrieval and Return Apparatus further comprises a support member fixed in an angled disposition by a brace means. The brace means includes a post brace having a first end, which is integrally attached to the support member at a portion of support member. The brace means further comprises a post bracket, which is removably securable to a post.

It will thus be seen that the '428 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '428 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '428 Patent does not teach a backstop net assembly, which is sized and shaped to be concentrical with the superior border and lateral borders of a typical vertically-oriented backboard.

U.S. Pat. No. 5,971,873 ('873 Patent), which issued to Balducci, discloses a Backstop Screen for Basketball hoop. The Backstop screen for Basketball hoop comprises an elongated post that vertically extends from a basketball post of a basketball hoop assembly to an upper horizontal support arm. The upper support arm supports a screen or net that hangs down behind the backboard of a basketball hoop assembly. A shot basketball hits the retrieval device and causes the shot basketball t roll back onto the court instead of landing off the court. A lower support arm is attached to the bottom of the post of the basketball hoop assembly and secures the bottom of the net in tension.

It will thus be seen that the '873 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '873 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '873 Patent does not teach a backstop net assembly, which is sized and shaped to be concentrical with the superior border and lateral borders of a typical. vertically-oriented backboard.

U.S. Pat. No. 6,056,652 ('652 Patent), which issued to Lees et al. discloses a Basketball Retrieval Device. The Basketball Retrieval Device comprises front net support arms, which are pivotally attached to an attachment plate.

The front net support arms are received in tubes, which are welded to the attachment plate. The tubes define hollow channels for receiving the tubular front net support arms. The orientation of the tubes on the attachment plate is depicted in a perspective view in FIG. No. 8. These features further disclose elements that are pertinent to a discussion of obviousness, discussed below.

It will thus be seen that the '652 Patent does not teach the use of a backstop net assembly in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that the '652 Patent does not teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that the '652 Patent does not teach a backstop net assembly, which is sized and shaped to be concentrical with the superior border and lateral borders of a typical vertically-oriented backboard.

U.S. Pat. No. 6,074,313 ('313 Patent), which issued to Pearson, discloses a Basketball Return Net Assembly. The Basketball Return Net Assembly comprises a flexible foldable return net having an upper end with an upper sleeve portion extending therealong, an elongated rigid net carrying member removably insertable into the upper sleeve portion to enable the net to be suspended in a laterally-extended configuration from the net-carrying member, and at least one attachment member for securing the net-carrying member to an upper portion of the hoop support behind the hoop. The net also has a lower end portion for receiving ballast to retain the lower end of the net in a laterally extended configuration at a selected location on the ground. Further, No. ('865 Disclosure), now U.S. Pat. No. 6,595,877 which was published on Feb. 28, 2002 to applicant Pearson, discloses a Basketball Return Net Assembly with Adjustment Bracket. The Basketball Return Net Assembly with Adjustment Bracket comprises a post extending upwardly from the ground and carrying a basketball hoop adjacent an upper end thereof The return net assembly includes a flexible foldable return net and an elongated rigid net-carrying member extending along the upper end of the net to enable the net to be supported in a laterally-extending configuration. The upper end of the net and the net-carrying member can be suspended from an upper portion of the hoop support behind the hoop, and an attachment bracket is connected to opposite lower corner portions of the net and is adjustably securable to the post to enable the bracket to be adjusted relative thereto.

It will thus be seen that neither the '313 Patent nor the '865 Disclosure teach the use of a backstop net assembly in combination with a basketball hoop assembly, which backstop net assembly comprises a multi-socketed mounting block. attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly. It will be further seen that neither the '313 Patent nor the '865 Disclosure teach a backstop net assembly kit for outfitting existent basketball hoop assemblies so that basketball players may selectively outfit basketball hoop assemblies for catching, collecting and/or gathering errant basketball shots for easier basketball retrieval. Further, it is noted that neither the '313 Patent nor the '865 Patent teach a backstop net assembly, which is sized and shaped to be concentrical with the superior border and lateral borders of a typical vertically-oriented backboard.

Of the numerous basketball retrieval and/or collection apparatuses that have been developed, many provide a net assembly for catching or collecting errant basketball shots either for return to the basketball court or for return to basketball players or for preventing basketball landings in regions adjacent to the basketball hoop assembly. In this regard, it has been shown that basketball retrieval and/or collection apparatus of various types are known in the prior art. However, in addition to often being exorbitantly priced, the numerous basketball retrieval or collection apparatuses that have been developed are often cumbersome to practice or require a structurally specific basketball hoop assemblage with which to operate. Further, the numerous basketball retrieval or collection apparatuses that have been developed often do not fold or collapse into compact arrangements for shipment or storage. Further, the numerous basketball retrieval or collection apparatuses that have been developed are not configured to be installed onto existing basketball hoop assemblies from a kit.

The prior art thus perceives a need for a basketball-gathering backstop net assembly, installable on basketball hoop assemblies, which assembly is less cumbersome to practice and which assembly may properly be utilized in combination with a wide variety of basketball hoop assemblies. Further, the prior art perceives a need for a backstop net assembly usable in combination with a basketball hoop assembly, which backstop net assembly comprises a multi-socketed mounting block attachable to the basketball hoop assembly, a plurality of net extension rods removably insertable in or attachable to the mounting block, and a basketball-gathering net attachable to the net extension rods for catching, collecting and gathering errant basketball shots for easy retrieval by basketball players or for preventing basketball landings in regions adjacent to the basketball hoop assembly. Further, the prior art perceives a need for a basketball-gathering backstop net assembly kit, which kit may be delivered or stored in a compact state, and which, when unpacked, may be installed on existent basketball hoop assemblies for catching, collecting or gathering errant basketball shots. Further, the prior art perceives a need for a backstop net assembly kit for outfitting existent basketball hoop assemblies so that basketball players may selectively outfit basketball hoop assemblies for catching, collecting and/or gathering errant basketball shots for easier basketball retrieval. Still further, the prior art perceives a need for a backstop net assembly, which is sized and shaped to concentrically mirror or appear concentrical with the superior border and lateral borders of a typical vertically-oriented backboard. In this regard, the prior art perceives a need for a backstop net assembly, usable in combination with a basketball hoop assembly, which backstop net assembly is both more visually appealing and more efficient at catching, collecting or gathering errant basketball shots.

In this last regard, it is contemplated that the prior art perceives a need for a backstop net assembly that concentrically mirrors or appears concentrical with a typical vertically-oriented backboard. A structurally concentrical backstop net assembly is thought to be both more efficient at catching collecting or gathering errant basketball shots and less visually distracting to players taking visual aim at a vertically-oriented backboard. In this regard, it is contemplated that a structurally concentrical backstop net or screen is more efficient insofar as the outermost borders of a structurally concentrical backstop net assembly provide a border gathering region behind and beyond the borders of the typical vertically-oriented backboard, which gathering region has a structural dimension of substantially the same width measured from the outer borders of a typical vertically-oriented backboard.

Basketball players with moderate shooting skills are more likely than not to propel errant shots into the described border gathering region, which is immediately adjacent the outer borders of a typical vertically-oriented backboard, or in effect, just miss the vertically-oriented backboard. Basketball players are less likely to propel shots into other less concentrical area regions adjacent the typical vertically-oriented backboard. In this last regard, it is recognized that errant shots do, from time to time, travel to regions that are not immediately adjacent a typical vertically-oriented backboard. However, it is further contemplated that the prior art perceives a need for a selectively expandable system for increasing the structural width of the border gathering region behind and beyond the borders of the typical vertically-oriented backboard for catching, collecting or gathering extremely errant basketball shots, while maintaining a substantially concentrical structural appearance of the backstop net assembly from an anterior viewpoint.

SUMMARY OF THE INVENTION

Accordingly, it is an object of the present invention to provide a basketball-gathering backstop net assembly, installable on basketball hoop assemblies, which backstop net assembly, is less cumbersome to practice and which backstop net assembly may properly be utilized in combination with a wide variety of basketball hoop assemblies. It is a further object of the present invention to provide a backstop net assembly usable in combination with a basketball hoop assembly, which backstop net assembly comprises a multi-socketed mounting block attachable to the basketball hoop assembly, a plurality of net extension rods removably insertable in or attachable to the mounting block, and a basketball-gathering net attachable to the net extension rods for catching, collecting and gathering errant basketball shots for easy retrieval by basketball players or for preventing basketball landings in regions adjacent to the basketball hoop assembly. Further, it is an object of the present invention to provide a basketball-gathering backstop net assembly kit, which kit may be delivered or stored in a compact state, and which, when unpacked, may be installed on existent basketball hoop assemblies for catching, collecting or gathering errant basketball shots. Still further, it is an object of the present invention to provide a backstop net assembly kit for outfitting existent basketball hoop assemblies so that basketball players may selectively outfit basketball hoop assemblies for catching, collecting and/or gathering errant basketball shots for easier basketball retrieval. Still further, it is an object of the present invention to provide a backstop net assembly which is sized and shaped to be concentrical with the superior border and lateral borders of a typical vertically-oriented backboard. In this regard, it is a further object of the present invention to provide a backstop net assembly which is both more visually appealing and more efficient at catching, collecting or gathering errant basketball shots.

To achieve these and other readily apparent objectives, the present invention provides a backstop net assembly and kit for use in combination with a basketball hoop assembly, which generally comprises a multi-socketed mounting block, a plurality of net extension rods, and a ball-gathering net assembly. The mounting block comprises a superior face, an inferior face, a left lateral face, a right lateral face, an anterior face, and a posterior face. The mounting block further comprises a superior mounting flange adjacent the superior and anterior faces, and an inferior mounting flange adjacent the inferior and anterior faces. The mounting block further comprises a plurality of rod-receiving sockets intermediate the superior face and the inferior face.

The net extension rods each comprise a male block attachment end, a female net attachment end, and a flexible rod intermediate the male block attachment end and the female net attachment end. The male block attachment ends are for removable insertion in the rod-receiving sockets. The ball-gathering net assembly comprises a ball-gathering net and a plurality of spaced net markers. The ball-gathering net comprises a superior net portion, an inferior net portion, and opposing lateral net portions. The spaced net markers are fixedly attached to the superior net portion and the female net attachment ends each have connector means for removably connecting the female net attachment ends to the superior net portion adjacent the spaced net markers. The connector means may be further defined by comprising in combination laterally-aligned tie strap-receiving apertures and a tie strap. The tie strap-receiving apertures have tie aperture pairing for threadably receiving the tie strap. The tie straps each have a male tie end and a female tie end. The male tie end may be threaded through the tie aperture pairing, around the appropriately marked superior net portion and through the female end for removably connecting the female net attachment ends to the superior net portion adjacent the spaced net markers. The female net attachment ends are further sized and shaped to receive male block attachment ends of additional net extension rods should a user wish to couple the net extension rods in the described manner to increase the extending length of the extension rod system.

The backstop net assembly further comprises means for securing the mounting block in vertically-oriented relation to a basketball hoop assembly. In this regard, it is contemplated that the mounting block may preferably either be welded to the upright support post of a basketball hoop assembly or be clamped to the upright support post of a basketball hoop assembly. When clamping the mounting block to the upright support post of a basketball hoop assembly, a superior hose clamp secures the superior mounting flange to the upright support post of a basketball hoop assembly and an inferior hose clamp secures the inferior mounting flange to the upright support post of a basketball hoop assembly.

The backstop net assembly further comprises means for securing the inferior net portion either to a playing surface or to the upright support post. When securing the inferior net portion to a playing surface, it is contemplated that ground stakes may be utilized in situations where the playing surface is easily piercable by a ground stake. Further, when securing the inferior net portion to a playing surface, which is not easily piercable, any suitable weighty material may be placed on laterally opposite corners of the inferior net portion to weigh down the inferior net portion. Further, the opposite corners of the inferior net portion may further comprise lengths of cord to tie the laterally opposite corners of the inferior net portion to the upright support post, thus producing a ball-gathering sack-like configuration.

The mounting block may be further summarized whereby the superior face has a vertically-oriented superior rod-receiving socket. Furthermore, the left lateral face has an angled left superior rod-receiving socket and an angled left inferior rod-receiving socket, and the right lateral face has an angled right superior rod-receiving socket and an angled right inferior rod-receiving socket. The superior, vertically-oriented rod-receiving socket has a longitudinal axis 90° from the inferior face. The left superior angled rod-receiving socket has a longitudinal axis 45° from the inferior face and the left inferior angled rod-receiving socket has a longitudinal axis 10° from the inferior face. Similarly, the right superior angled rod-receiving socket has a longitudinal axis 45° from the inferior face and the right inferior angled rod-receiving socket has a longitudinal axis 10 ° from the inferior face.

Typically, on a basketball playground, one can find at least one upright support post, a backboard mounted on the post, and a basketball rim and net structure mounted on the backboard. The present invention thus provides an improved basketball backstop screen to contain errant basketball shots launched by a basketball shooter to minimize basketball retrieval time and possible damage to surrounding valuables. The ball-gathering net is a reticulated net having a size and width, which extends vertically and laterally via the extension rods a sufficient distance to capture errant basketball shots and to assist in keeping the basketball in play. Additionally, a heavy perimeter cord peripherally bounds the reticulated portion of the net to provide added strength to the reticulated, ball-gathering net.

Other objects of the present invention, as well as particular features, elements, and advantages thereof, will be elucidated in, or apparent from, the following description and the accompanying drawing figures.

BRIEF DESCRIPTION OF THE DRAWINGS

Other features of our invention will become more evident from a consideration of the following detailed description of our patent drawings, as follows:

FIG. No. 1 is a front plan view of the preferred embodiment of the backstop net assembly in combination with a basketball hoop assembly.

Figure 1:
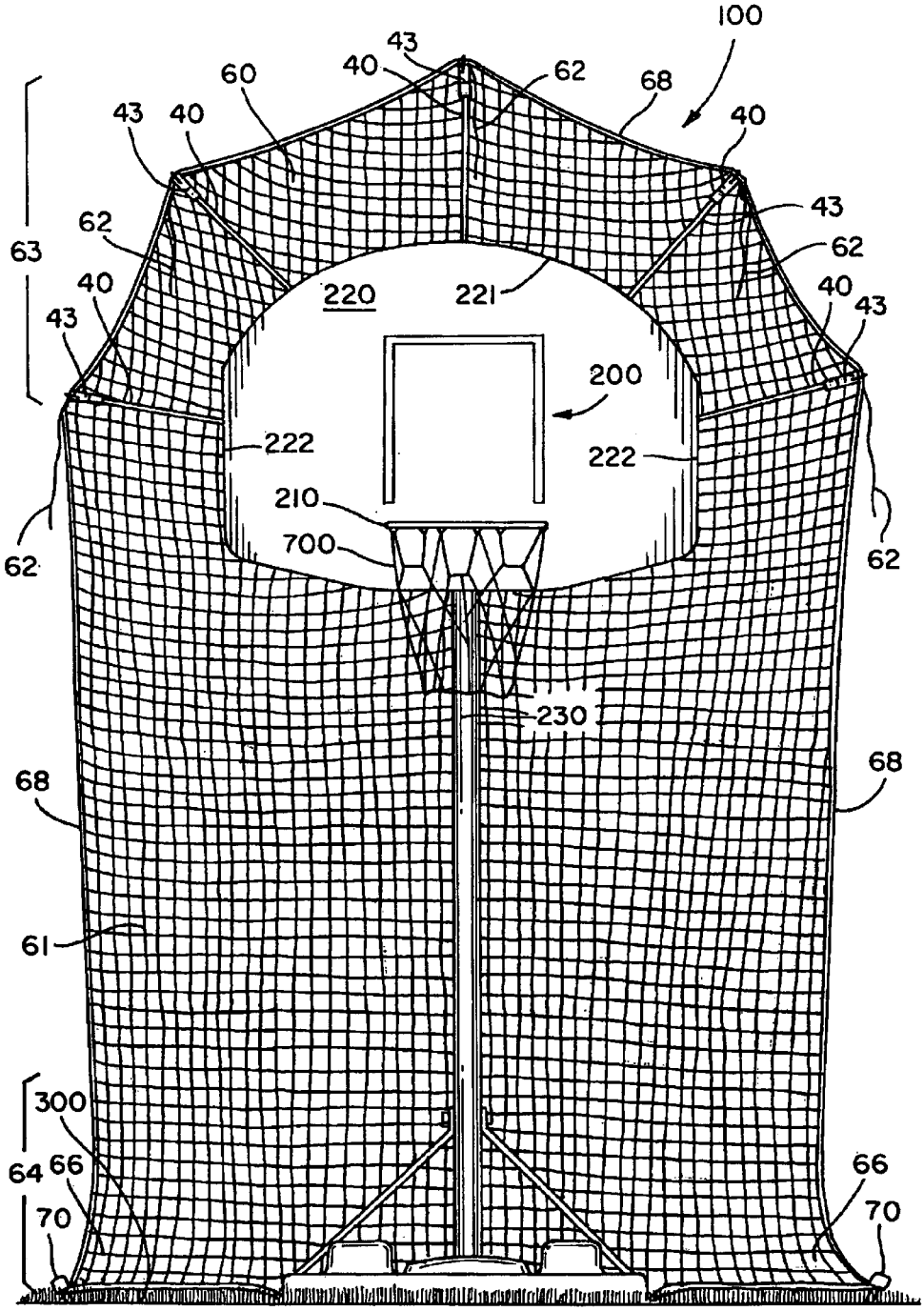
Figure 2:
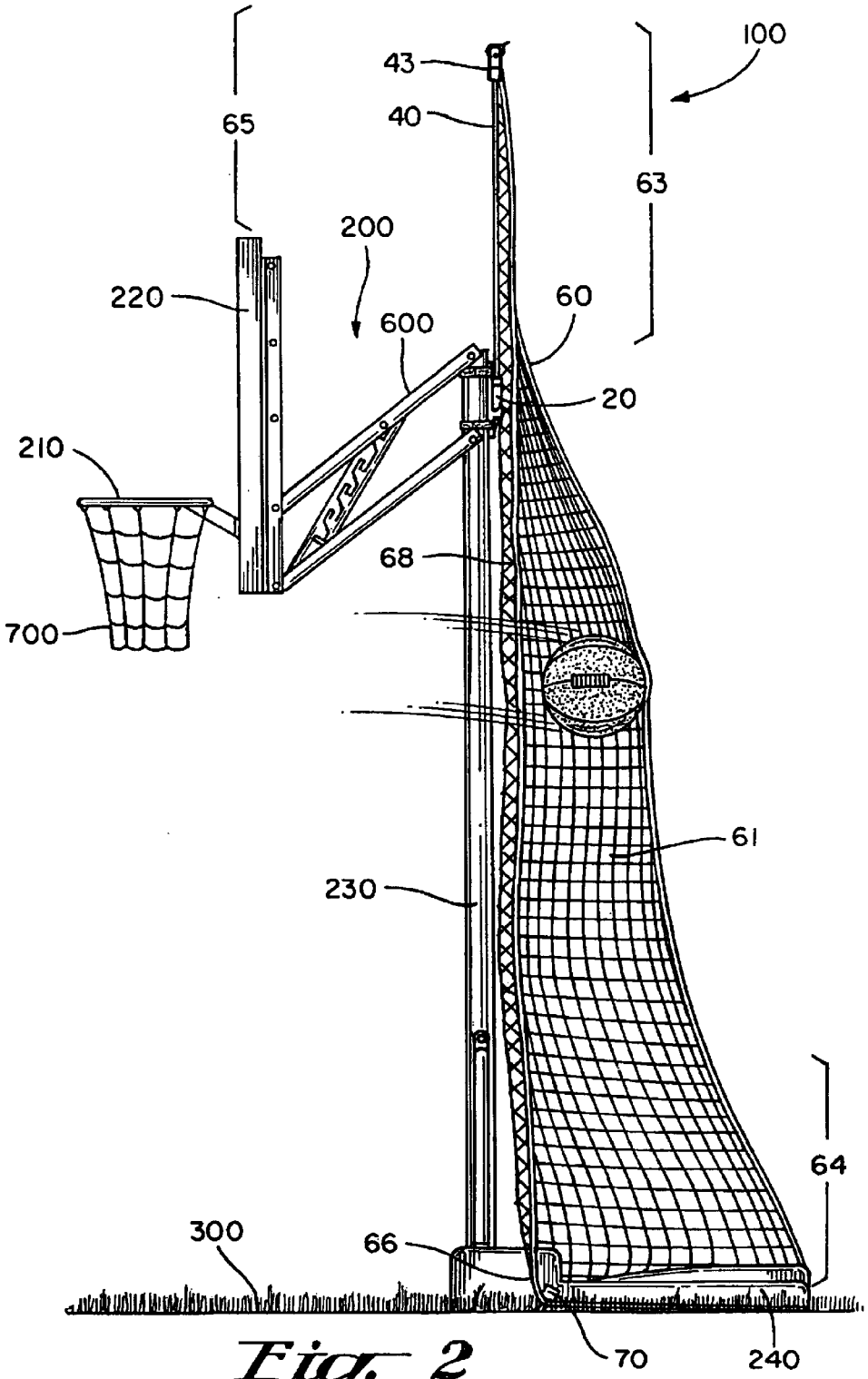
Figure 3:
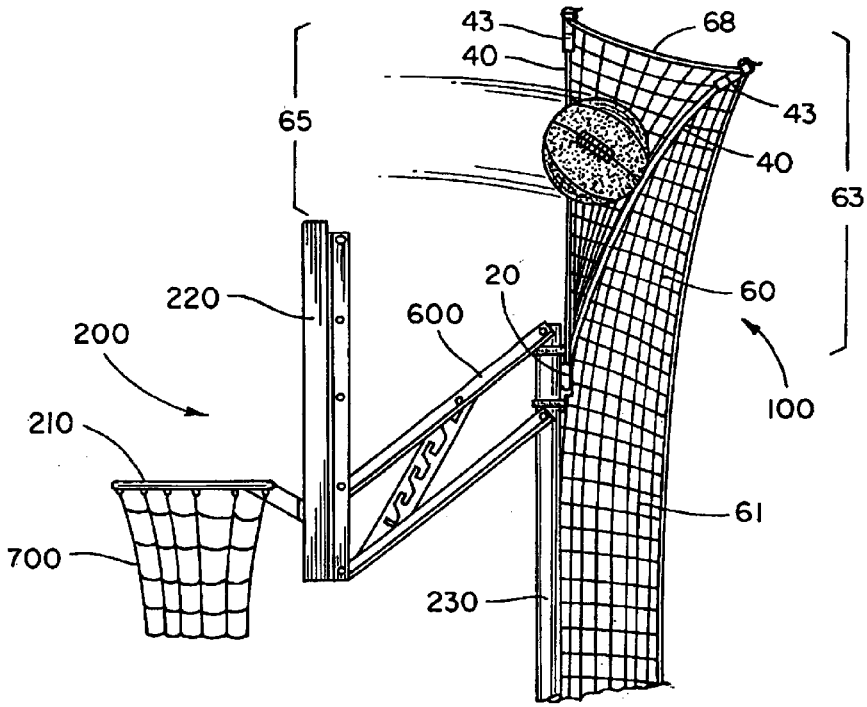
Figure 4:
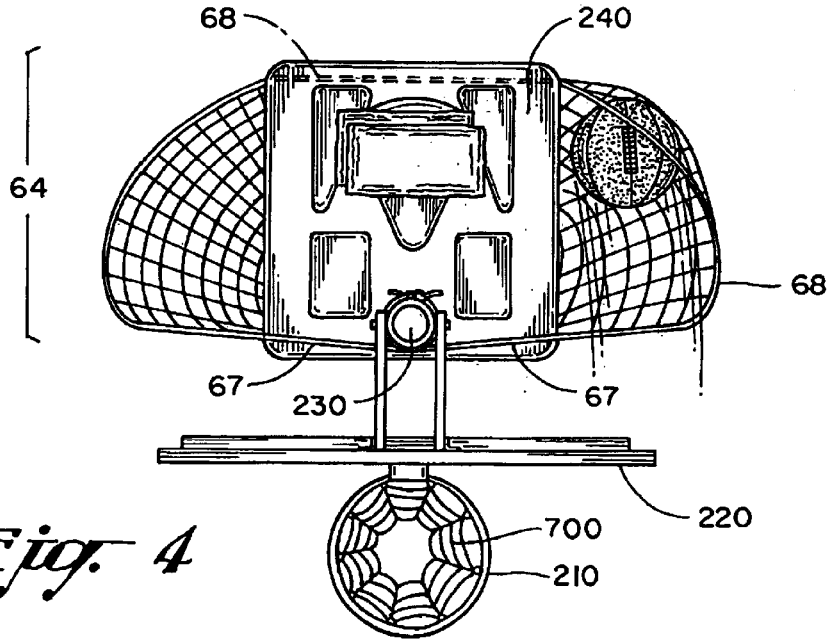
Figure 5:
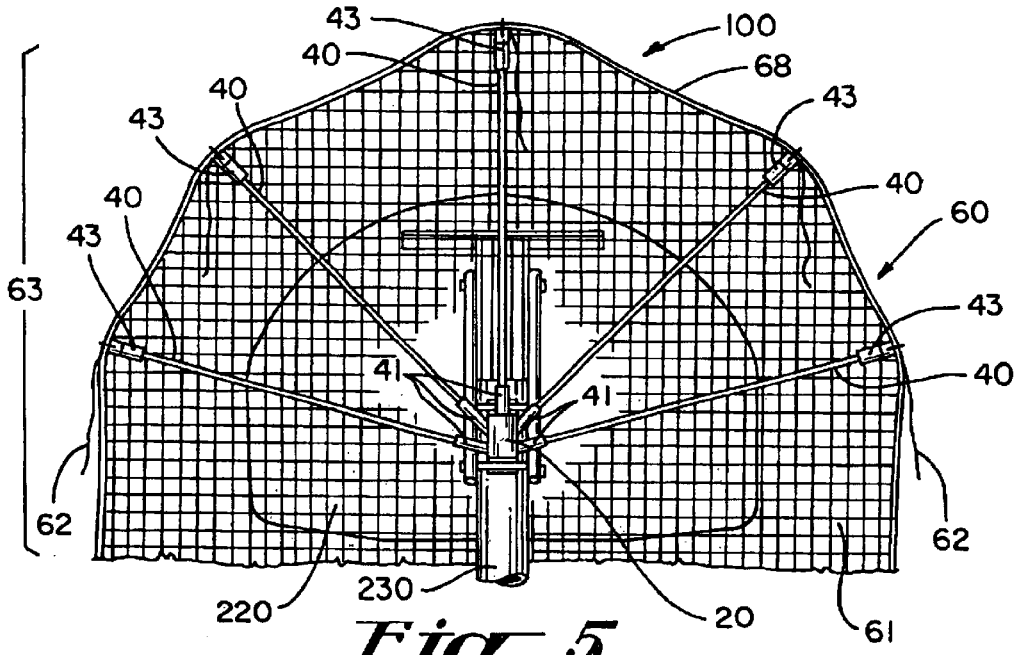
Figure 6:
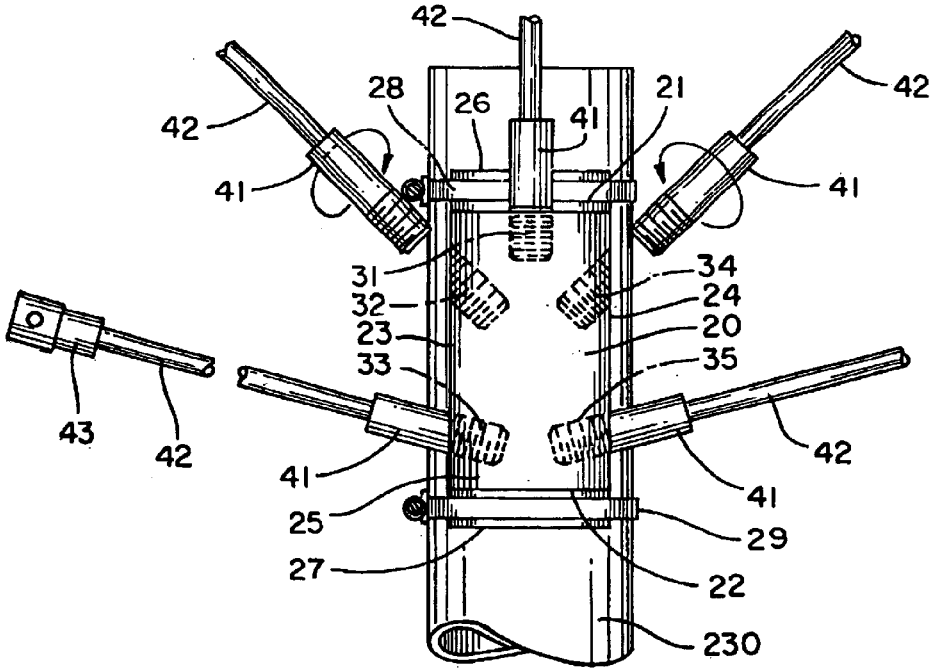
Figure 7A:
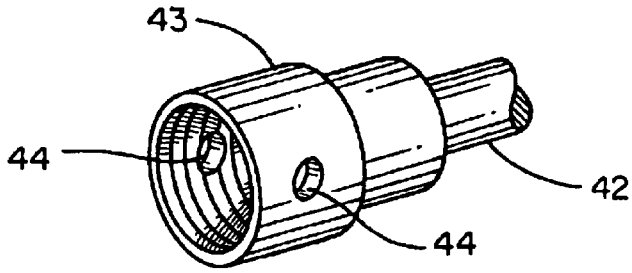
Figure 7B:
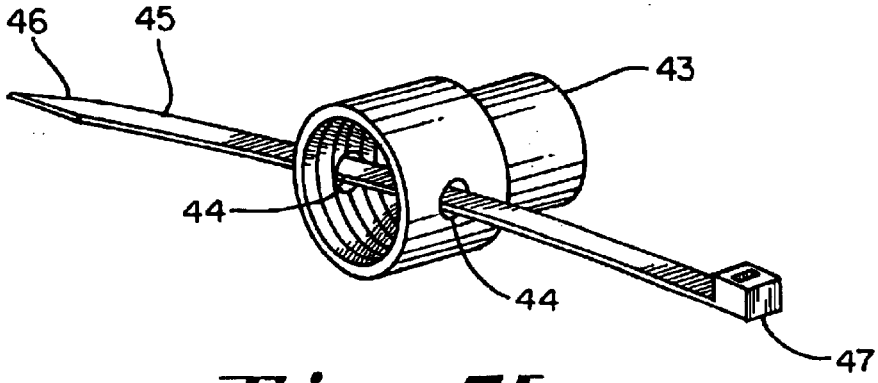
Figure 7C:
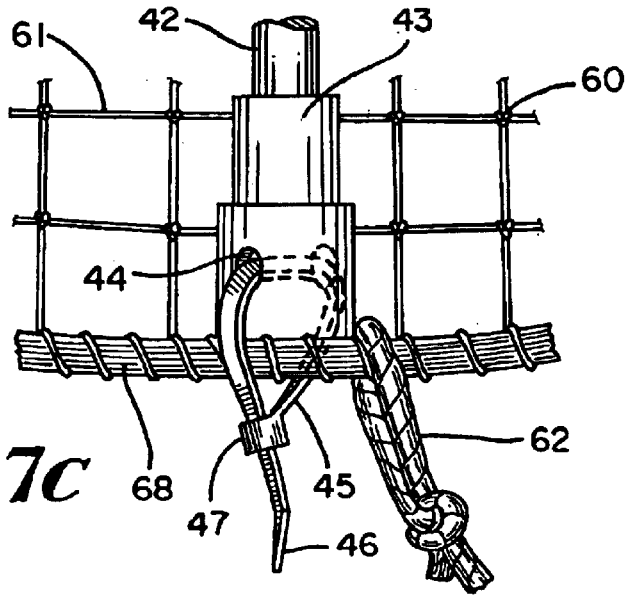
Figure 8:
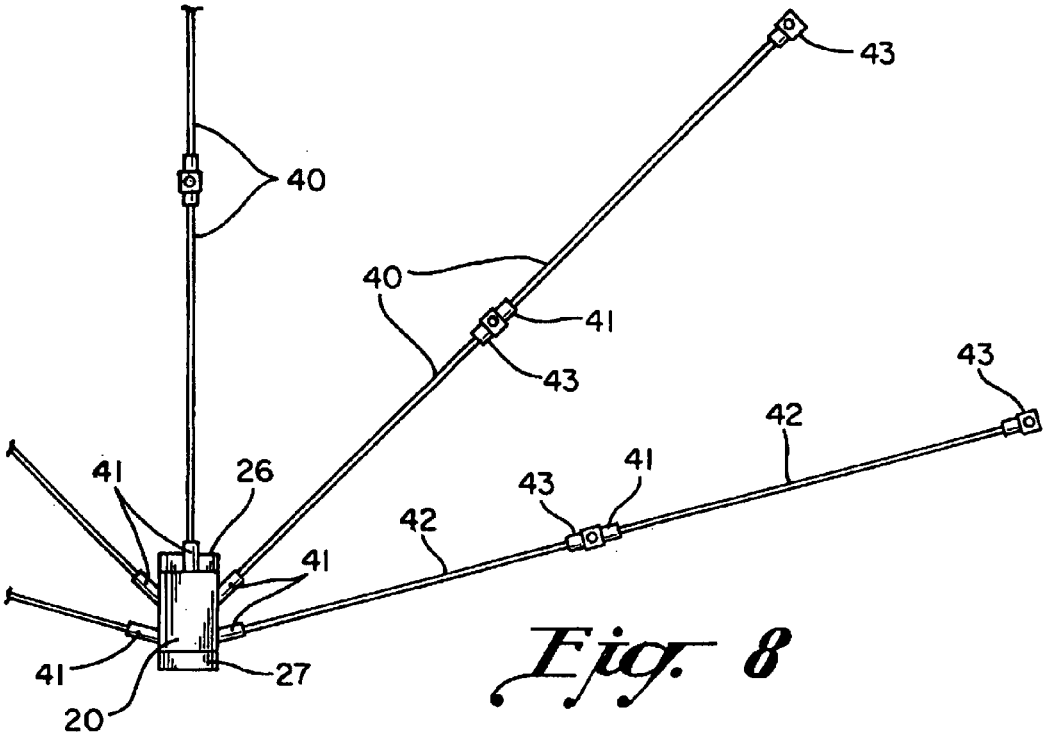
Figure 9:
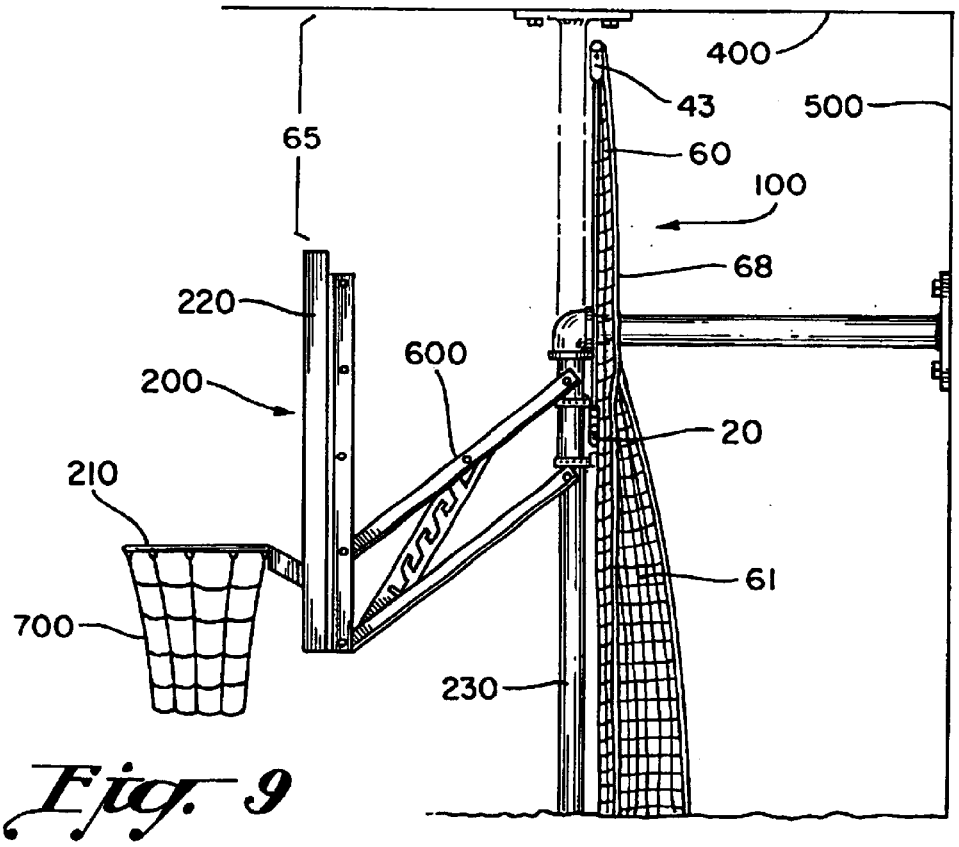
Figure 10:
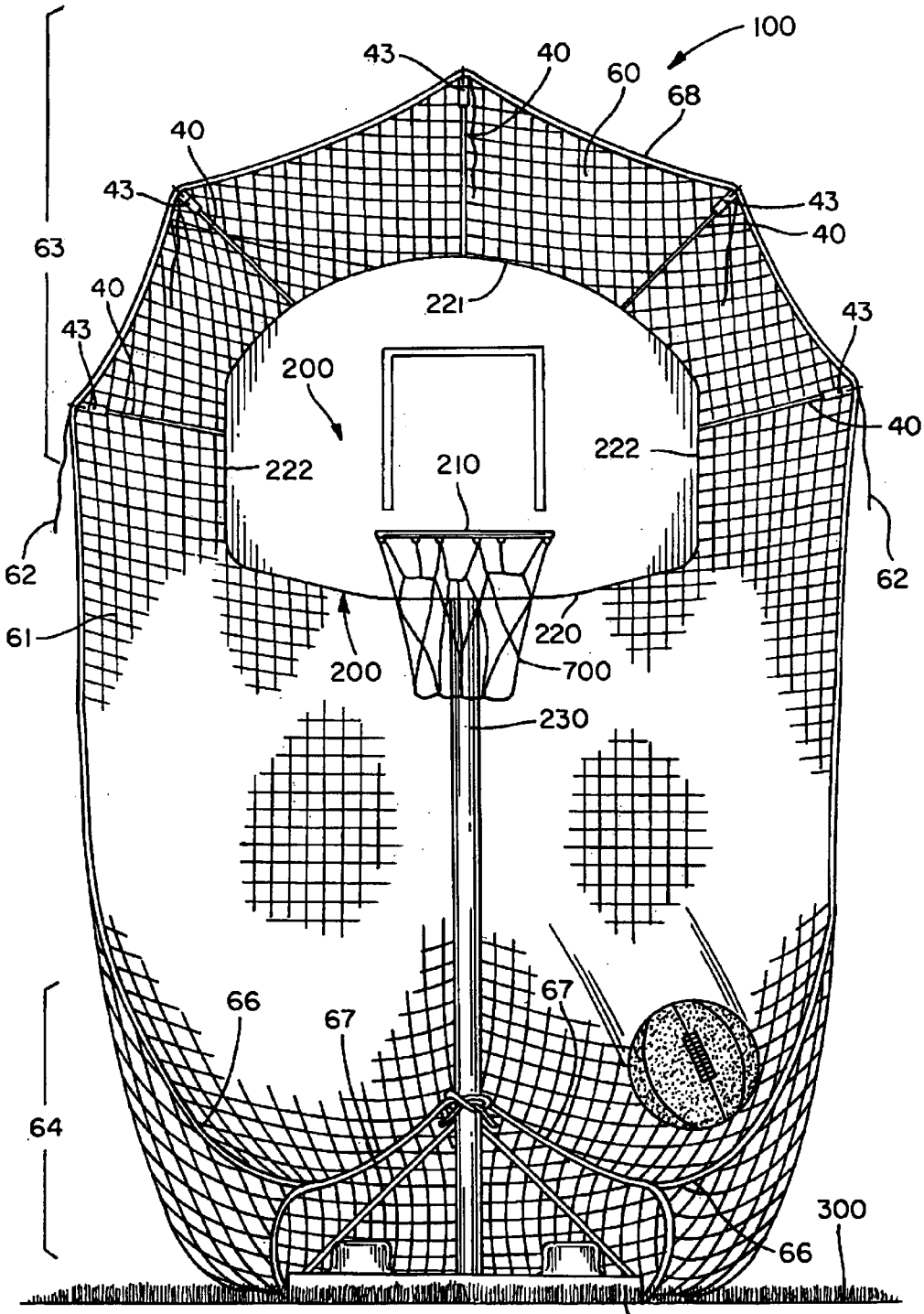
Figure 11:
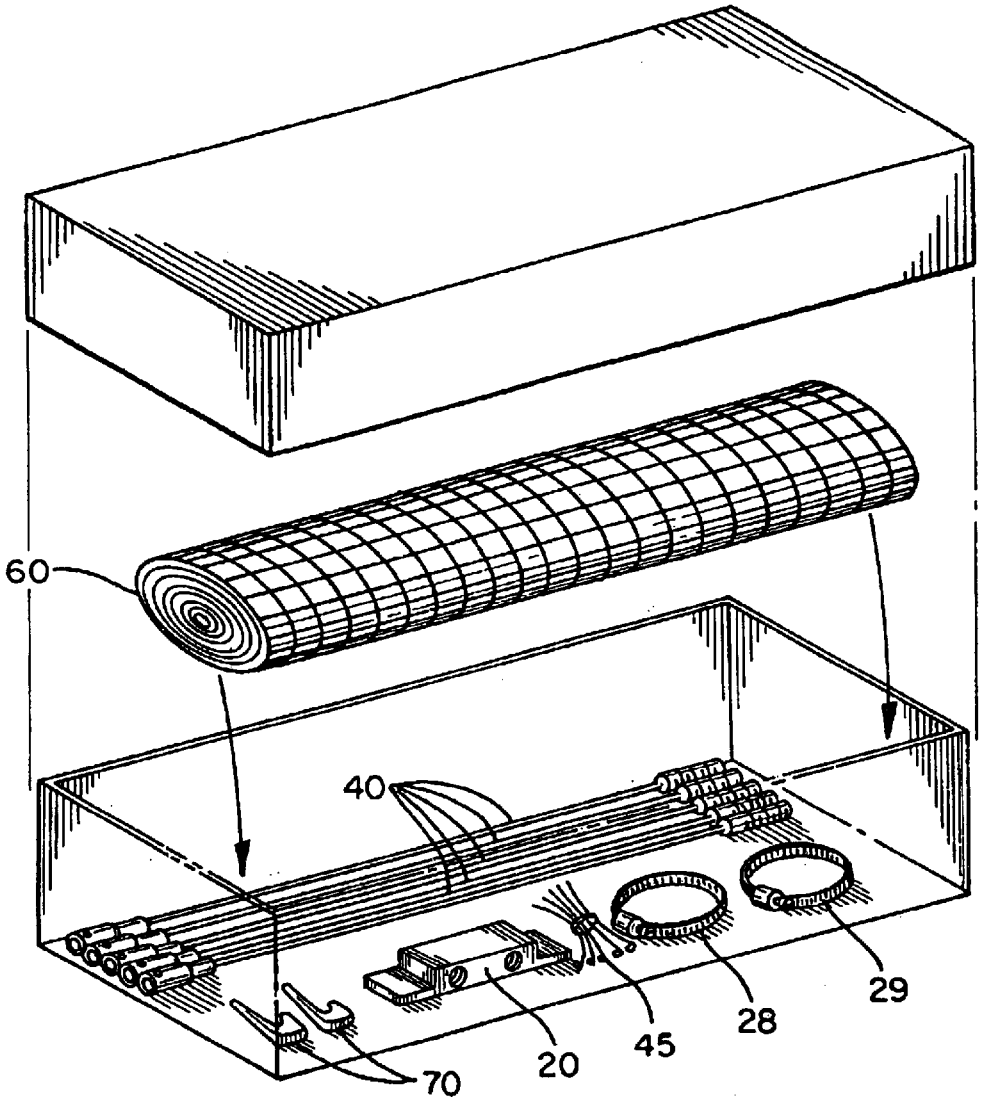

FIG. No. 2 is a side plan view of the preferred embodiment of the backstop net assembly in combination with a basketball hoop assembly showing an errant basketball shot being gathered at an inferior location.

FIG. No. 3 is a fragmentary side plan view of the preferred embodiment of the backstop net assembly in combination with a basketball hoop assembly showing an errant basketball shot being gathered at a superior location.

FIG. No. 4 is a fragmentary top plan view of the preferred embodiment of the backstop net assembly in combination with a basketball hoop assembly with parts removed to show an errant basketball shot being gathered at an inferior location.

FIG. No. 5 is a fragmentary back plan view of the preferred embodiment of the backstop net assembly in combination with a basketball hoop assembly with parts broken away to show the mounting block attached to an upright support post.

FIG. No. 6 is a fragmentary back plan view of the mounting block secured to an upright support post of a basketball hoop assembly with fragmentary net extension rods in various stages of removable insertion in the mounting block.

FIG. No. 7(*a*) is an enlarged perspective view of a female net attachment end showing cooperative tie aperture pairing.

FIG. No. 7(*b*) is an enlarged perspective view of a female net attachment end showing a tie strap inserted laterally through cooperative tie aperture pairing.

FIG. No. 7(*c*) is an enlarged frontal view of a tie strap attaching a female net attachment end to the superior net portion adjacent a net marker.

FIG. No. 8 is a fragmentary back view of the mounting block with coupled net extension rods inserted in the mounting block.

FIG. No. 9 is a fragmentary side view of an alternative embodiment of the backstop net assembly in combination with a basketball hoop assembly, showing phantom basketball hoop and backboard support means.

FIG. No. 10 is a front plan view of the preferred embodiment of the backstop net assembly in combination with a basketball hoop assembly showing opposite corners of the inferior net portion tied to the upright support post of the basketball hoop assembly.

FIG. No. 11 is a fragmentary perspective view of the backstop net assembly kit in a disassembled state.

DETAILED DESCRIPTION OF THE PREFERRED EMBODIMENTS

Referring now to the drawings, the preferred embodiment of the present invention concerns a backstop net assembly for use in combination with a basketball hoop assembly or a backstop net assembly kit for outfitting a basketball hoop assembly. In this regard, FIG. No. 1 illustrates a basketball hoop assembly and backstop net assembly combination as viewed from an extreme anterior or frontal view and FIG. No. 11 illustrates a backstop et assembly kit as boxed for shipment or storage. The basketball hoop assembly and backstop net assembly combination generally comprises a backstop net assembly 100 as illustrated in FIG. Nos. 1–3, 5, 9 and 10 for use in combination with a basketball hoop assembly 200 as illustrated in FIG. Nos. 1–3, 9, and 10. It is recognized that generic basketball hoop assemblies are well known in the prior art. To meet the structural requirements of the disclosed combination, basketball hoop assembly 200 may typically comprise a horizontally-oriented, basketball-receiving hoop 210 as illustrated in FIG. Nos. 1–4, 9 and 10; a vertically-oriented backboard 220 as illustrated in FIG. Nos. 1–5, 9 and 10; and support means or means for supporting the backboard and hoop assemblage in vertical relation to the ground or playing surface 300 as illustrated in FIG. Nos. 1, 2 and 10. It is noted that typical vertically-oriented backboards comprise a substantially arcuate superior border 221 as illustrated in FIG. Nos. 1 and 10, or a substantially straight superior border (not illustrated), and substantially straight lateral borders 222 as further illustrated in FIG. Nos. 1 and 10.

Typically, basketball hoop assemblies of the portable type comprise support means, which may further be defined as comprising an upright support post 230 as generally illustrated in FIG. Nos. 1, 2–6, 9 and 10. It is further contemplated, however, that the present invention can be utilized in combination with many different types of basketball hoop assemblies, including, but not limited to, those that comprise permanent vertical support posts fixedly attached to a horizontal surface, such as playing surface 300 or to a ceiling 400 as illustrated in FIG. No. 9. Further, it is contemplated that the present invention can be utilized in combination with a horizontal support post fixedly attached to a vertical surface, such as a wall 500 as further illustrated in FIG. No. 9.

However, should the user desire to utilize backstop net assembly 100 in combination with a horizontal support post of the type described and illustrated, the user must slightly modify the backstop net assembly. Specifically, ball-gathering net assembly 60 must comprise means for allowing a horizontal post to pierce the body portion of the ball-gathering net 61 and mounting block 20 must have means for attachment to the horizontal post so that the longitudinal axes of the rod-receiving sockets are disposed in a vertical orientation.

The support means or means for supporting the backboard and hoop assemblage must support the backboard and hoop assemblage such that the support means posits the backboard and hoop assemblage in anterior or forwardly spaced relation to the support means. The present invention thus may be used in combination with a basketball hoop assembly having both some means for supporting the backboard and hoop assemblage in vertical relation to the ground or playing surface 300 and additionally some means for supporting the backboard and hoop assemblage in anterior or forwardly spaced relation to the support means.

In this last regard, it is noted that many different types of basketball hoop assemblies comprise means 600 for supporting the backboard and hoop assemblage in anterior or forwardly spaced relation to the support means, an example of which is illustrated in FIG. Nos. 2, 3 and 9. So long as means 600 for supporting the backboard and hoop assemblage does not structurally interfere with the posterior side or posterior portions of upright support post 230 or the support means, backstop net assembly 100 may be successfully attached to the basketball hoop assembly for catching, collecting or gathering errant basketball shots. It is further contemplated that many basketball hoop assemblies comprise further peripherals such as a basketball net 700 as generally illustrated in FIG. Nos. 1–4, 9 and 10. So long as further peripherals such as basketball hoop net 700 do not structurally interfere with the posterior side or posterior portions of upright support post 230 or the support means, backstop net assembly 100 may be successfully attached to the basketball hoop assembly for catching, collecting or gathering errant basketball shots.

Backstop net assembly 100 generally comprises a mounting block 20, a plurality of net extension rods 40 and a ball-gathering net assembly 60. Mounting block 20 is preferably constructed by welding a block having measured dimensions of 1.5 inches by 3 inches by ¾ inch to a mounting plate having measured dimensions of 1.5 inches by 4 inches by ⅛ inch. Source material for the mounting plate and block is not limited to one specific type. Possibilities for choice include stainless steel, stock steel, molded aluminum, and high density plastic. It is contemplated that mounting block 20 may be integrally fabricated with upright support post 230 in which case mounting block 20 may be welded directly to the pole or upright support post 230 during processing. In such case, only materials suitable for welding should be used. Further, when mounting block 20 is fabricated with upright support post 230, no mounting plate is required.

Mounting block 20, as generally illustrated in FIG. Nos. 2, 3, 5, 6, 8, 9 and 11, further comprises a superior face 21, an inferior face 22, a left lateral face 23, a right lateral face 24, an anterior face (not shown), and a posterior face 25 as illustrated in FIG. No. 6. Mounting block 20 further comprises a superior mounting flange 26 adjacent superior face 21 and the anterior face and an inferior mounting flange 27 adjacent inferior face 22 and the anterior face as further illustrated in FIG. Nos. 6 and 8. Mounting block 20 further preferably comprises net extension rod attachment means or means for attaching net extension rods 40 to mounting block 20. In this regard, it is contemplated the net extension rod attachment means or means for attaching net extension rods 40 to mounting block 20 preferably comprise a plurality of threaded rod-receiving sockets intermediate superior face 21 and inferior face 22 as further generally illustrated in FIG. No. 6. Superior mounting flange 26 and inferior mounting flange 27 are extensions of the mounting plate which has been welded to the block as described. Correctly welded, the block should be centered on the welding plate preferably leaving at least a ½-inch flange on either side.

It is further contemplated that the anterior face or preferable mounting plate construction may further comprise means for allowing the anterior face to lie in flush adjacency with upright support post 230 or be attached to upright support post 230 such that the anterior face does not rock against a differently shaped upright support post. For example, should a round upright support post support the basketball hoop and backboard assemblage, a rounded or concave-like anterior face is contemplated. Further, it is contemplated that a flat anterior face with forwardly-extending, upright support post-engaging protuberances may snugly fit the anterior face portion of the mounting block to the upright support post so as to provide structure to prevent a rocking effect when the anterior face is not similarly shaped as compared to the shape of the upright support post.

Backstop net assembly 100 preferably further comprises means for mounting mounting block 20 to upright support post 230. It is here recognized that there are many ways to attach or mount the described mounting block to a support means or upright support post, an exhaustive list of which is excluded from this writing. It is understood that it is within the ordinary skill of a person skilled in the art to devise obviously equivalent means for attaching or mounting the described mounting block to a support means or upright support post and an exhaustive list would be unduly lengthy. Excellent results have been achieved in this last regard, however, where the mounting means are preferably further defined by comprising a superior hose clamp 28 and an inferior hose clamp 29 as illustrated in FIG. Nos. 6 and 11. Superior hose clamp 28 and inferior hose clamp are preferably constructed of stainless steel and are sized and shaped to fit circular cross-section support posts or poles having measured diameters of about 3.5 inches to 6 inches. It is contemplated that additional hose clamps may be made available if the support post is of greater diameter or has square cross sectional configuration. Superior hose clamp 28 attaches or mounts superior mounting flange 26 to upright support post 230 and inferior hose clamp 29 attaches or mounts inferior mounting flange 27 to upright support post as illustrated in FIG. No. 6. Superior hose clamp 28 and inferior hose clamp 29 are illustrated in an unassembled state in FIG. No. 11. The preferred mounting means thus engage with superior mounting flange 26 and inferior mounting flange 27 of mounting block 20 in vertically spaced relation. The rod-receiving sockets are located between or intermediate superior hose clamp 28 and inferior hose clamp 29 to enable net extension rods 40 to engage in the rod-receiving sockets without interference with either superior hose clamp 28 or inferior hose clamp 29.

Superior face 21 preferably has a vertically-oriented superior rod-receiving socket 31. Further, left lateral face 23 has an angled left superior rod-receiving socket 32 and an angled left inferior rod-receiving socket 33; and right lateral face 24 has an angled right superior rod-receiving socket 34 and an angled right inferior rod-receiving socket 35 all as illustrated in FIG. No. 6. Preferably, vertically-oriented superior rod-receiving socket 31 has a longitudinal axis preferably measuring 90° from a horizontal or from inferior face 22. Further, left superior angled rod-receiving socket 32 has a longitudinal axis preferably measuring 45° from a horizontal or from inferior face 22 and left inferior angled rod-receiving socket 33 has a longitudinal axis preferably measuring 10° from a horizontal or from inferior face 22. Right superior angled rod-receiving socket 34 has a longitudinal axis preferably measuring 45° from a horizontal or from inferior face 22 and right inferior angled rod-receiving socket 35 has a longitudinal axis preferably measuring 10 ° from a horizontal or from inferior face 22. Preferably, socket 31, socket 32, socket 33, socket 34, and socket 35 are either ⅜ inch or ¼ inch National Pipe Thread (NPT) tapped and threaded sockets, which tapping and threading preferably occurs prior to welding the block to the mounting plate.

As earlier noted, backstop net assembly 100 further comprises net extension rods 40 as illustrated in FIG. Nos. 1–3, 5, 8, 10 and 11. Each net extension rod 40 comprises block attachment means for removably attaching net extension rods 40 to mounting block 20. Preferably, each block attachment means comprises a male block attachment end 41 as illustrated in FIG. Nos. 5, 6, 8 and 11. Each net extension rod 40 further preferably comprises a female net attachment end 43 opposite male block attachment end 41 as illustrated in FIG. Nos. 1–3, 6 and 9 and a flexible rod 42 intermediate male block attachment end 41 and female net attachment end 43 as illustrated in FIG. Nos. 6, 7(*a*), 7(*c*) and 8. Male block attachment ends 41 are primarily for removable insertion in the rod-receiving sockets as generally illustrated in FIG. Nos. 6 and 8. It should be further noted from an inspection of FIG. No. 8 that male block attachment ends 41 may also be inserted in female net attachment ends 43 as a means to increase or effectively double the overall net extension rod length. In this regard, female net attachment ends 43 are sized and shaped to receive male block attachment ends 41. Female net attachment ends 43 preferably have a female fitting and male block attachment ends 41 each preferably have a male fitting, the male fittings for removable insertion in the female fittings. It is further contemplated that backstop net assembly 100 may comprise either 5 or 10 net extension rods 40 depending on whether users may wish to effectively double the net extension rod length. Male block attachment ends 41 and female net attachment ends are each preferably constructed of pressed steel and sized at either ⅜ inch or ¼ inch NPT. Flexible rods 42 are each preferably constructed of 90,000 psi tensile strength fiberglass, are minimally conductive when wet and may be Ultraviolet (UV) protected where required. Flexible rods 42 each have a preferred maximum measured length of about 5 feet (maximum doubled or extended length of about 10 feet) and a preferred minimum measured length of about 4 feet. It is recognized that errant shots do, from time to time, travel to regions that are not immediately adjacent a typical vertically-oriented backboard. In this regard, the described selectively expandable system for increasing the structural width of a border gathering region 65 behind and beyond the borders of the typical vertically-oriented backboard for both catching, collecting or gathering extremely errant basketball shots as illustrated in FIG. Nos. 2, 3 and 9, and maintaining a substantially concentrical structural appearance of the backstop net assembly from an anterior viewpoint as needed as generally illustrated in FIG. Nos. 1, 5 and 10.

Female net attachment ends 43 each further comprise connector means for removably connecting female net attachment ends 43 to ball-gathering net assembly 60 as generally illustrated in FIG. Nos. 1, 2, 3, 5, 7(*c*), 9 and 10. In this regard, the connector means may preferably be further defined by comprising in combination laterally-aligned tie strap-receiving apertures 44 and a tie strap 45. Tie strap-receiving apertures 44 are preferably constructed by boring a ⅛ inch hole through the female net attachment ends 43 as illustrated in FIG. Nos. 7(*a*), 7(*b*) and 7(*c*). One tie strap 45 is illustrated in FIG. Nos. 7(*b*) and 7(*c*) and a bunch of tie straps 45 is illustrated in FIG. No. 11. The tie strap-receiving apertures 44 of each female net attachment end 43 have tie aperture pairing for threadably receiving a tie strap 45; that is a tie strap 45 may thus be threaded through the tie strap-receiving apertures 44 or through the tie aperture pairing. Tie straps 45 each comprise a male tie end 46 and a female tie end 47 as illustrated in FIG. No. 7(*b*) and 7(*c*). Each male -tie end 46 may thus be threaded through the described tie aperture pairing, around a specified portion or marked portion of ball-gathering net assembly 60, and through female tie end 47 for removably connecting female net attachment ends 43 to a specified portion of ball-gathering net assembly 60, as will be discussed in more detail below and as specifically illustrated in FIG. No. 7(*c*). It is contemplated that each backstop net assembly 100, when sold, will preferably be provided with a large quantity of tie straps for frequent storage or replacement. Tie straps 45 preferably have a minimum 18 pound tensile strength and are UV protected. Each tie strap 45 preferably has a minimum length of 4.03 inches (102.40 mm) and a minimum width of 0.094 inch (2.390 mm).

Ball-gathering net assembly 60 preferably comprises a ball-gathering net 61 as illustrated in FIG. Nos. 1–3, 5, 7(*c*), 9 and 10, and a plurality of spaced net markers 62 as illustrated in FIG. Nos. 1, 5, 7(*c*) and 10. Ball-gathering net 61 comprises a superior net portion 63 and an inferior net portion 64. Superior net portion 63 is generally illustrated in FIG. Nos. 1–3, 5 and 10 and inferior net portion 64 is generally illustrated in FIG. Nos. 1, 2, 4 and 10. Ball-gathering net 61 preferably comprises minimum net weave sized at 1 ¾ inches square and has a minimum break strength of about 164 pounds (74.7 kilograms). Preferably, ball-gathering net 61 has a minimum net life of five (5) years in outdoor application. The preferred minimum net dimensions are sized at approximately thirteen feet by eight feet. In this last regard, it is rioted, however that the preferred ball-gathering net 61 comprises a superior net portion 63, which comprises angled attachment points, which angled attachment points, when connected to female net attachment ends 43 form a structural net assembly having the appearance of being concentric with a vertically-oriented backboard when attached to a basketball hoop assembly as generally illustrated in FIG. Nos. 1, 5 and 10. It is further noted that should the user elect to increase the net extension length, a ball-gathering net having larger dimensions is required.

Superior net portion 63 of backstop net assembly 100, when attached to basketball hoop assembly 200, thus concentrically mirrors or appears concentrical with a typical vertically-oriented backboard 220. As earlier noted, a structurally concentrical backstop net assembly is thought to be both more efficient at catching collecting or gathering errant basketball shots and is less visually distracting to players taking visual aim at vertically-oriented backboard 220 or basketball-receiving hoop 210. A structurally concentrical backstop net or screen is thought to be more efficient insofar as the outermost borders of superior net portion 63 of a structurally concentrical backstop net assembly provide a border gathering region 65 (as illustrated in FIG. Nos. 2, 3 and 9) behind and beyond arcuate superior border 221 and straight lateral borders 222 of a typical vertically-oriented backboard 220, which border gathering region 65 has a structural dimension of substantially the same width measured from arcuate superior border 221 and straight lateral borders 222 of a typical vertically-oriented backboard 220. Basketball players with moderate shooting skills are thus more likely than not to propel errant shots into border gathering region 65 as specifically illustrated in FIG. No. 3, which border gathering region is immediately adjacent arcuate superior border 221 and straight lateral borders 222 of a typical vertically-oriented backboard, or in effect, just miss the vertically-oriented backboard 220. Basketball players are less likely to propel shots into other regions beyond this substantially concentrical border area or border gathering region 65.

The basketball hoop assembly and backstop net assembly combination preferably further comprises means for securing inferior net portion 64 to playing surface 300 or to upright support post 230. When securing inferior net portion 64 to playing surface 300, it is contemplated that ground stakes 70 may preferably be utilized in situations where playing surface 300 is easily piercable by a ground stake 70, such as on grass or earth or gravel surfaces. Ground stakes 70 are illustrated in FIG. Nos. 1 and 2 staking laterally opposite corners 66 of inferior net end 64 to the ground and preferably comprise constructed heavy duty molded plastic stakes having rounded edges and molded tie hooks. The outdoor life of ground stakes 70 should be about 2 years minimum and each stake should preferably have a length ranging from 6 inches to 12 inches. Further, when securing inferior net portion 64 to a playing surface 300, which is not easily piercable, any suitable weighty material may be placed on laterally opposite corners 66 of inferior net portion 64 to weigh down inferior net portion 64. In this regard, it is contemplated that sand bags or similar other massive bag-like weights may be used to weigh down inferior net portion 64 in. adjacency to playing surface 300. The means for securing inferior net portion 64 to upright support post 230 preferably comprises a length of cord 67 attached to each opposite corner 66 as illustrated in FIG. Nos. 4 and 10. By thus attaching opposite corners 66 to upright support post 230, the user creates a sack-like inferior net portion 64 as generally illustrated in FIG. No. 10 for further gathering errant shots.

Ball-gathering net 61 preferably further comprises a thickened perimeter cord 68, which circumscribes the entire ball gathering net as illustrated in FIG. Nos. 1–5, 7(*c*), 9 and 10. Perimeter cord 68 preferably comprises 5/16 inch poly rope cross-stitched onto the net proper or ball-gathering net 61 as a border on all sides. Perimeter rope 68 thus provides added strength to ball-gathering net 61 and preferably may be inserted underneath the typical support base 240 of portable basketball hoop assemblies as illustrated in FIG. Nos. 2, 4 and 10. This is an added beneficial feature, particularly when the user elects to attach opposite corners 66 to upright support post 230 for creating a sack-like inferior net portion 64 for further gathering errant shots as generally illustrated in FIG. No. 10. It is further helpful when the user stakes inferior net portion 64 to the playing surface as illustrated in FIG. No. 1. By thus feeding perimeter cord 68 underneath support base 240 of portable basketball hoop assemblies, errant shots are less likely to exit backstop net assembly 100 between playing surface 300 or the ground and inferior net portion 64.

Further, spaced net markers 62 are preferably attached to perimeter cord 68 at angled portions of superior net portion 63 in an assembled state as shown in FIG. Nos. 1, 5 and 10. Net markers 62 thus denote attachment points for female net attachment ends 43 so that users may quickly attach female net attachment ends 43 to perimeter cord 68 at the designated locations so as to provide a more concentric superior net portion 63 when in an assembled state. Further, net markers 62 are preferably of a different color than the remainder of ball-gathering net 61. In this regard, it is contemplated that ball-gathering net preferably comprises light absorbent coloration and net markers 62 each preferably comprise light reflective coloration. The light absorbent coloration decreases distracting visual effects of backstop net assembly 100 and the light reflective coloration improves attracts the user to those attachment points for female net attachment ends 43.

The disclosed backstop net assembly, in kit form, comprises mounting block 20, a plurality of net extension rods 40 (preferably 3–10 net extension rods), superior-hose clamp 28, inferior hose clamp 29, a plurality of tie straps 45 (supplied in large quantity), ball-gathering net assembly 60, and ground stakes 70, all as illustrated in an unassembled, compact state in FIG. No. 11. The backstop net assembly kit may thus be utilized to outfit an existing basketball hoop assembly in the manner described herein.

Alternative Embodiment

An alternative embodiment of the present invention concerns a backstop net assembly for use in combination with a basketball hoop assembly, virtually identical to the preferred embodiment of the present invention save for the number of net extension rods 40 inserted into mounting block 20. For example, users may elect to selectively remove net extension rods 40 from vertically-oriented superior rod-receiving socket 31, left superior angled rod-receiving socket 32, left inferior angled rod-receiving socket 33, right superior angled rod-receiving socket 34, or right inferior angled rod-receiving socket 35. For example, if the user elects to remove net extension rods 40 from left superior angled rod-receiving socket 32 and right superior angled rod-receiving socket 34, the resultant backstop net assembly comprises three net extension rods 40, the female net attachment ends 43 of which attach at three junction points on superior net portion 63. While not specifically shown, it is believed that removal of net extension rods 40 in the described manner to create a backstop net assembly comprising three extension rods is within the skill of a person skilled in the art and hence no further description is required.

It will thus be seen that the present invention provides a basketball-gathering backstop net assembly, installable on basketball hoop assemblies, which backstop net assembly is less cumbersome to practice and which backstop net assembly may properly be utilized in combination with a wide variety of basketball hoop assemblies. It will be further seen that the present invention provides a backstop net assembly usable in combination with a basketball hoop assembly, which backstop net assembly comprises a multi-socketed mounting block attachable to the basketball hoop assembly, a plurality of net extension rods removably insertable in the mounting block, and a basketball-gathering net attachable to the net extension rods for catching, collecting and gathering errant basketball shots for easy retrieval by basketball players or for preventing basketball landings in regions adjacent to the basketball hoop assembly.

Still further, it will be seen that the present invention provides a basketball-gathering backstop net assembly kit, which kit may be delivered or stored in a compact state, and which, when unpacked, may be installed on existent basketball hoop assemblies. for catching, collecting or gathering errant basketball shots. Still further, it will be seen that the present invention provides a backstop net assembly kit for outfitting existent basketball hoop assemblies so that basketball players may selectively outfit basketball hoop assemblies for catching, collecting and/or gathering errant basketball shots for easier basketball retrieval. Still further, it will be seen that the present invention provides a backstop net assembly which is sized and shaped to concentrically mirror or appear concentrical with the superior border and lateral borders of a typical vertically-oriented backboard from an anterior viewpoint. In this regard, it will be seen that the present invention provides a backstop net assembly which is both more visually appealing and more efficient at catching, collecting or gathering errant basketball shots.

While the above description contains much specificity, this specificity should not be construed as limitations on the scope of the invention, but rather as an exemplification of the invention. For example, mounting means for attaching mounting block 20 to upright support post 230 need not comprise superior hose clamp 28 and inferior hose. clamp 29. So long as the mounting means fixedly connects the mounting block to the upright support post, with the longitudinal axes of the rod-receiving sockets disposed in some vertical relation, the mounting means successfully fulfills its mounting purpose. Further, the means for securing inferior net portion 64 to playing surface 300 need not comprise ground stakes. So long as the means for securing inferior net portion 64 to playing surface 300, the means successfully fulfills is securing purpose. Further, the net extension rod attachment means need not necessarily comprise a plurality of rod-receiving sockets and the block attachment means need not necessarily comprise a male block attachment end. It is contemplated that a plurality of male mounting protuberances, integrally formed with the mounting block, may replace the rod-receiving sockets and that female block attachment ends may replace the male block attachment ends for receiving the male mounting protuberances. The mounting block, thus configured, may further act a central junction hub for attaching radially extending net extension rods for providing a border gathering region above and behind the borders of a given basketball backboard. Furthermore, in this last regard, it is contemplated that basketball backboards come in various shapes and sizes. It is thus contemplated that the net extension rods may come in various lengths and be selectively attached to the mounting block in the manner described to structurally achieve a plurality of differently sized and shaped border gathering regions which appear concentrical with variously shaped basketball backboards from an anterior viewpoint.

Accordingly, although the invention has been described by reference to a preferred embodiment and an alternative embodiment, it is not intended that the novel device be limited thereby, but that modifications thereof are intended to be included as falling within the broad scope and spirit of the foregoing disclosure, the following claims and the appended drawings.

We claim:

1. In an outdoor basketball playground including an upright support post, a backboard mounted on the post, and a basketball rim and net structure mounted on the backboard, the improvement of an outdoor basketball backstop screen to contain errant basketball shots launched by a basketball shooter to minimize basketball retrieval time and possible damage to surrounding things, the backstop screen comprising a reticulated net having a size and width extending vertically and widthwise a sufficient distance to capture errant basketball shots and to assist in keeping the basketball in play, a cord peripherally bounding the reticulated net to provide added strength to the reticulated net, a mounting block, means attaching the mounting block to the post, the mounting block having a series of outwardly opening threaded sockets contained within said mounting block periphery, net supporting rods retainingly engaged in said outwardly opening threaded sockets, and means joining outer ends of said net supporting rods with said cord and said net above and behind the basketball backboard to provide a backstop to hinder errant basketball shots going astray and to speed up play.

2. The outdoor basketball playground of claim 1 wherein the mounting block has upper and lower mounting block flanges, said means for mounting the mounting block engaged with said mounting block flanges to secure the mounting block flanges to the post.

3. The outdoor basketball playground of claim 2 wherein said means for mounting the mounting block comprises a pair of clamps, which engage with the mounting block flanges in vertically spaced relation and with the mounting block sockets being located between the clamps and radiating outwardly from the post to enable the rods to engage in the socket without interference with the pair of clamps.

4. An outdoor basketball backscreen kit for assembly with an upright support post for a basketball backboard and net assembly, the kit including a rod mounting block, attachment means for attaching the rod-mounting block to the upright support post behind the basketball backboard, a reticulated net having a width broader than the basketball backboard and a height taller than the upright support post for capture and return of errant basketball shots from a shooter when a shot misses the backboard, a heavy cord circumscribing the reticulated net, means connecting the cord to the reticulated net, the mounting block having a series of spaced outwardly opening threaded block sockets contained within said mounting block periphery, a series of flexible rods having rod ends for threaded engagement with the spaced outwardly opening block sockets, the flexible rods being knocked down when in disassembly as a kit, and means for detachable assembly of outer ends of flexible rods with the heavy cord.

5. The outdoor basketball backscreen kit of claim 4 wherein the mounting block has upper and lower mounting block flanges, said means for mounting the mounting block engaged with said mounting block flanges to secure the mounting block flanges to the post.

6. The outdoor basketball backscreen kit of claim 5 wherein said means for mounting the mounting block comprises a pair of clamps, which engage with the mounting block flanges in vertically spaced relation and with the mounting block sockets being located between the clamps and radiating outwardly from the upright support post to enable the rods to engage in the socket without interference with the pair of clamps.

7. A basketball hoop assembly and backstop net assembly combination, the basketball hoop assembly and backstop net assembly combination comprising:

a basketball hoop assembly, the basketball hoop assembly comprising:

a horizontally-oriented, basketball-receiving hoop;

a vertically-oriented backboard, the basketball-receiving hoop being fixedly mounted to the vertically-oriented backboard;

support means for supporting the vertically-oriented backboard in vertical relation to a ground surface;

a backstop net assembly, the backstop net assembly comprising:

a mounting block, the mounting block comprising a superior face, an inferior face, a left lateral face, a right lateral face, an anterior face, a posterior face, and a plurality of threaded rod-receiving sockets contained within said mounting block periphery, intermediate the superior face and the inferior face;

a plurality of net extension rods, the net extension rods each comprising a male block attachment end, a female net attachment end, and a flexible rod intermediate the male block attachment end and the female net attachment end, the male block attachment ends for removable insertion in the rod-receiving sockets, the female net attachment ends each further comprising connector means;

a ball-gathering net, the ball-gathering net comprising a superior net portion and an inferior net portion, the connector means for removably connecting the female net attachment ends to the superior net portion in spaced relation; and means for securing the mounting block to the support means, the mounting block being secured in vertically-oriented, posterior relation to the vertically-oriented backboard.

8. The basketball hoop assembly and backstop net assembly combination of claim 7 wherein the support means is further defined by comprising a vertically-oriented support post.

9. The basketball hoop assembly and backstop net assembly combination of claim 8 wherein the mounting block further comprises a superior mounting flange adjacent the superior face and anterior face, an inferior mounting block adjacent the inferior face and anterior face, and the means for securing the mounting block to the support post is further defined by comprising a superior hose clamp for securing the superior mounting flange to the basketball hoop assembly and an inferior hose clamp for securing the inferior mounting flange to the basketball hoop.

10. The basketball hoop assembly and backstop net assembly combination of claim 9 wherein the superior face has a vertically-oriented superior rod-receiving socket, the left lateral face has an angled left superior rod-receiving socket and an angled left inferior rod-receiving socket, and the right lateral face has an angled right superior rod-receiving socket and an angled right inferior rod-receiving socket.

11. The basketball hoop assembly and backstop net assembly combination of claim 10 wherein the superior, vertically-oriented rod-receiving socket has a longitudinal axis 90° from the inferior face, the left superior angled rod-receiving socket has a longitudinal axis 45° from the inferior face, the left inferior angled rod-receiving socket has a longitudinal axis 10° from the inferior face, the right superior angled rod-receiving socket has a longitudinal axis 45° from the inferior face and the right inferior angled rod-receiving socket has a longitudinal axis 10° from the inferior face.

12. The basketball hoop assembly and backstop net assembly combination of claim 11 wherein the female net attachment ends are sized and shaped to receive the male block attachment ends.

13. The basketball hoop assembly and backstop net assembly combination of claim 12 wherein the superior net portion further comprises a plurality of spaced net markers, the spaced net markers being fixedly attached to the superior net portion, the connector means removably connecting the female net attachment ends to the superior net portion adjacent the spaced net markers.

14. The backstop net assembly of claim 11 wherein each connector means may be further defined by comprising in combination laterally-aligned tie strap-receiving apertures and a tie strap, the tie strap-receiving apertures having tie aperture pairing for threadably receiving the tie strap, the tie straps each having a male tie end and a female tie end, the male tie end being threaded through the tie aperture pairing, around the superior net portion and through the female end for removably connecting the female net attachment ends to the superior net portion adjacent the spaced net markers.

15. The basketball hoop assembly and backstop net assembly combination of claim 7 wherein the vertically-oriented backboard comprises a superior border and laterally-opposite borders, the superior net portion being sized and shaped to appear concentrical with the superior border and the laterally-opposite borders when viewed from an anterior viewpoint.

16. The basketball hoop assembly and backstop net assembly combination of claim 7 wherein the basketball hoop assembly and backstop net assembly combination further comprises means for securing the inferior net portion to a playing surface.

17. A backstop net assembly for use in combination with a basketball hoop assembly, the backstop net assembly comprising:

a mounting block, the mounting block comprising a superior face, an inferior face, a left lateral face, a right lateral face, an anterior face, a posterior face, a superior mounting flange adjacent the superior face and anterior face, an inferior mounting flange adjacent the inferior face and anterior face, and a plurality of rod-receiving sockets contained within said mounting block periphery, intermediate the superior face and the inferior face;

a plurality of net extension rods, the net extension rods each comprising a male block attachment end, a female net attachment end, and a flexible rod intermediate the male block attachment end and the female net attachment end, the male block attachment ends for removable insertion in the rod-receiving sockets; and a ball-gathering net assembly, the ball-gathering net assembly comprising a ball-gathering net and a plurality of spaced net markers, the ball-gathering net comprising a superior net portion, an inferior net portion, and opposed lateral net portions, the spaced net markers being fixedly attached to the superior net portion, the female net attachment ends each having connector means for removably connecting the female net attachment ends to the superior net portion adjacent the spaced net markers.

18. The backstop net assembly of claim 17 wherein the backstop net assembly further comprises means for securing the mounting block in vertically-oriented relation to a basketball hoop assembly.

19. The backstop net assembly of claim 18 wherein the means for securing the mounting block to the basketball hoop assembly is further defined by comprising a superior hose clamp for securing the superior mounting flange to the basketball hoop assembly and an inferior hose clamp for securing the inferior mounting flange to the basketball hoop assembly.

20. The backstop net assembly of claim 17 wherein the superior face has a vertically-oriented superior rod-receiving socket, the left lateral face has an angled left superior rod-receiving socket and an angled left inferior rod-receiving socket, and the right lateral face has an angled right superior rod-receiving socket and an angled right inferior rod-receiving socket.

21. The backstop net assembly of claim 20 wherein the superior, vertically-oriented rod-receiving socket has a longitudinal axis 90° from the inferior face, the left superior angled rod-receiving socket has a longitudinal axis 45° from the inferior face, the left inferior angled rod-receiving socket has a longitudinal axis 10° from the inferior face, the right superior angled rod-receiving socket has a longitudinal axis 45° from the inferior face and the right inferior angled rod-receiving socket has a longitudinal axis 10° from the inferior face.

22. The backstop net assembly of claim 17 wherein the female net attachment ends are sized and shaped to receive the male block attachment ends.

23. The backstop net assembly combination of claim 17 wherein the superior net portion further comprises a plurality of spaced net markers, the spaced net markers being fixedly attached to the superior net portion, the connector means removably connecting the female net attachment ends to the superior net portion adjacent the spaced net markers.

24. The backstop net assembly of claim 23 wherein each connector means may be further defined by comprising in combination laterally-aligned tie strap-receiving apertures and a tie strap, the tie strap-receiving apertures having tie aperture pairing for threadably receiving the tie strap, the tie straps each having a male tie end and a female tie end, the male tie end being threaded through the tie aperture pairing, around the superior net portion and through the female end for removably connecting the female net attachment ends to the superior net portion adjacent the spaced net markers.

25. The backstop net assembly of claim 17 wherein the backstop net assembly further comprises means for securing the inferior net portion to a playing surface.

26. A backstop net assembly for use in combination with a basketball hoop assembly, the backstop net assembly comprising:

a mounting block, the mounting block comprising a superior block end, an inferior block end, and net extension rod attachment means contained with said mounting block periphery, plurality of net extension rods, the net extension rods each comprising net rod attachment means, a net extension rod attachment means, a net attachment end, and a flexible rod intermediate the block attachment means and the net attachment end, the block attachment means for removably attaching the net extension rods to the net extension rod attachment means, the net attachment ends each further comprising connector means; and a ball-gathering net, the ball-gathering net comprising a superior net portion and an inferior net portion, the connector means for removably connecting the net attachment ends to the superior net portion in spaced relation.

27. The backstop net assembly of claim 26 wherein the backstop net assembly further comprises means for securing the mounting block in vertically-oriented relation to a basketball hoop assembly.

28. The backstop net assembly of claim 26 wherein the backstop net assembly further comprises means for securing the inferior net portion to a playing surface.

29. The backstop net assembly of claim 26 wherein the block attachment means are each further defined by comprising a male block attachment end, the net extension rod attachment means is further defined by comprising a plurality of rod-receiving sockets intermediate the superior block end and the inferior block end, and the net attachment ends are sized and shaped to couple with the block attachment ends.

30. The backstop net assembly combination of claim 26 wherein the superior net portion further comprises a plurality of spaced net markers, the spaced net markers being fixedly attached to the superior net portion, the connector means removably connecting the female net attachment ends to the superior net portion adjacent the spaced net markers.

31. A backstop net assembly kit for outfitting a basketball hoop assembly, the backstop net assembly kit comprising:

a mounting block, the mounting block comprising a superior face, an inferior face, a left lateral face, a right lateral face, an anterior face, a posterior face, a superior mounting flange adjacent the superior face and anterior face, an inferior mounting block adjacent the inferior face and anterior face, and a plurality of threaded rod-receiving sockets contained within said mounting block periphery, intermediate the superior face and the inferior face;

a plurality of net extension rods, the net extension rods each comprising a male block attachment end, a female net attachment end, and a flexible rod intermediate the male block attachment end and the female net attachment end, the male block attachment ends for removable insertion in the rod-receiving sockets; the female net attachment ends each further comprising connector means; and a ball-gathering net assembly, the ball-gathering net assembly comprising a ball gathering net and a plurality of spaced net markers, the ball-gathering net comprising a superior net portion, an inferior net portion, a left lateral net portion, and a right lateral net portion, the plurality of spaced net markers being fixedly attached to the superior net portion.

32. The backstop net assembly kit of claim 31 wherein the backstop net assembly further comprises means for securing the mounting block in vertically-oriented relation to a basketball hoop assembly.

33. The backstop net assembly kit of claim 32 wherein the means for securing the mounting block to the basketball hoop assembly is further defined by comprising a superior hose clamp for securing the superior mounting flange to the basketball hoop assembly and an inferior hose clamp for securing the inferior mounting flange to the basketball hoop assembly.

34. The backstop net assembly of claim 31 wherein the female net attachment ends are sized and shaped to receive the male block attachment ends.

35. The backstop net assembly of claim 31 wherein each connector means may be further defined by comprising in combination laterally-aligned tie strap-receiving apertures and a tie strap, the tie strap-receiving apertures having tie aperture pairing for threadably receiving the tie strap, the tie straps each having a male tie end and a female tie end, the male tie end being threaded through the tie aperture pairing, around the superior net portion and through the female end for removably connecting the female net attachment ends to the superior net portion adjacent the spaced net markers.

36. The backstop net assembly kit of claim 31 wherein the superior face has a vertically-oriented superior rod-receiving socket, the left lateral face has an angled left superior rod-receiving socket and an angled left inferior rod-receiving socket, and the right lateral face has an angled right superior rod-receiving socket and an angled right inferior rod-receiving socket.

37. The backstop net assembly kit of claim 36 wherein the superior, vertically-oriented rod-receiving socket has a longitudinal axis 90° from the inferior face, the left superior angled rod-receiving socket has a longitudinal axis 45° from the inferior face, the left inferior angled rod-receiving socket has a longitudinal axis 10° from the inferior face, the right superior angled rod-receiving socket has a longitudinal axis 45° from the inferior face and the right inferior angled rod-receiving socket has a longitudinal axis 10° from the inferior face.

38. The backstop net assembly kit of claim 31 wherein the backstop net assembly further comprises means for securing the inferior net portion to a playing surface.

39. A backstop net assembly kit for use in combination with a basketball hoop assembly, the backstop net assembly kit comprising:

a mounting block, the mounting block comprising a superior block end, an inferior block end, and a plurality of threaded rod-receiving sockets contained within said mounting block periphery, intermediate the superior block end and the inferior block end;

a plurality of net extension rods, the net extension rods each comprising a male block attachment end, a female net attachment end, and a flexible rod intermediate the male block attachment end and the female net attachment end, the male block attachment ends for removable insertion in the rod-receiving sockets; and a ball-gathering net, the ball-gathering net comprising a superior net portion and an inferior net portion.

40. The backstop net assembly kit of claim 39 wherein the backstop net assembly kit further comprises means for securing the mounting block in vertically-oriented relation to a basketball hoop assembly.

41. The backstop net assembly kit of claim 39 wherein the backstop net assembly kit further comprises means for securing the female net attachment ends to the superior net portion.

42. The backstop net assembly of claim 39 wherein the female net attachment ends are sized and shaped to receive the male block attachment ends.

43. The backstop net assembly kit of claim 39 wherein the backstop net assembly further comprises means for securing the inferior net portion to a playing surface.

* * * * *